US006471525B1

(12) United States Patent
Fan et al.

(10) Patent No.: US 6,471,525 B1
(45) Date of Patent: Oct. 29, 2002

(54) SHIELDED CARRIER FOR LAND GRID ARRAY CONNECTORS AND A PROCESS FOR FABRICATING SAME

(75) Inventors: Zhineng Fan, Santa Clara, CA (US); Ai D. Le, Sunnyvale, CA (US); Che-Yu Li, Ithaca, NY (US)

(73) Assignee: High Connection Density, Inc., Sunnyvale, CA (US)

( * ) Notice: Subject to any disclaimer, the term of this patent is extended or adjusted under 35 U.S.C. 154(b) by 22 days.

(21) Appl. No.: 09/772,641

(22) Filed: Jan. 30, 2001

Related U.S. Application Data

(60) Provisional application No. 60/227,859, filed on Aug. 24, 2000.

(51) Int. Cl.[7] ..... H01R 12/00
(52) U.S. Cl. ..... 439/70
(58) Field of Search ..... 439/70, 71, 66, 439/86, 91, 591, 68, 67; 361/719, 86

(56) References Cited

U.S. PATENT DOCUMENTS

| | | | | | |
|---|---|---|---|---|---|
| 4,868,638 | A | * | 9/1989 | Hirata et al. | 357/80 |
| 5,065,282 | A | * | 11/1991 | Polonio | 361/399 |
| 5,089,881 | A | * | 2/1992 | Panicker | 357/80 |
| 5,201,855 | A | * | 4/1993 | Ikola | 439/608 |
| 5,599,193 | A | * | 2/1997 | Crotzer | 439/66 |
| 5,864,205 | A | * | 1/1999 | Dworsky | 313/495 |
| 5,868,304 | A | * | 2/1999 | Brofman et al. | 228/254 |
| 5,869,356 | A | * | 2/1999 | Fuller, Jr. et al. | 438/126 |
| 5,966,803 | A | * | 10/1999 | Wilson | 29/840 |
| 6,056,557 | A | * | 5/2000 | Crotzer et al. | 439/66 |
| 6,071,755 | A | * | 6/2000 | Baba et al. | 438/106 |
| 6,084,781 | A | * | 7/2000 | Klein | 439/771 |
| 6,165,232 | A | * | 12/2000 | Tieber et al. | 29/25.01 |
| 6,201,194 | B1 | * | 3/2001 | Lauffer et al. | 174/264 |
| 6,264,476 | B1 | * | 7/2001 | Li et al. | 439/66 |

FOREIGN PATENT DOCUMENTS

| | | | | |
|---|---|---|---|---|
| JP | 62010833 | * | 1/1987 | 438/460 |
| JP | 10-22412 | * | 1/1998 | 439/66 |

* cited by examiner

*Primary Examiner*—Brian Sircus
*Assistant Examiner*—J. F. Duverne
(74) *Attorney, Agent, or Firm*—Salzman & Levy

(57) ABSTRACT

The present invention provides a carrier with electrical shielding of individual contact elements, resulting in LGA interposer connectors with improved electrical performance. The carrier includes a plurality of openings, each of which may contain an individual contact element. The openings may be plated with conductive material, and may also be commoned to one or more reference voltages (e.g., ground) present on at least one conductive layer of the carrier. The carrier may be as simple as a single unified structure with a conductive layer on one outer surface, or much more complex, having many layers of dielectric and conductive material. The carrier may also provide improved retention of the individual contact elements. The process to assemble one embodiment of the carrier is also disclosed.

17 Claims, 8 Drawing Sheets

SHIELDED CARRIER FOR LAND GRID ARRAY CONNECTORS AND A PROCESS FOR FABRICATING SAME

RELATED PATENT APPLICATIONS

This application is related to U.S. Pat. No. 6,264,476, issued to Li et al. for WIRE SEGMENT BASED INTERPOSER FOR HIGH FREQUENCY ELECTRICAL CONNECTION, which is based on application Ser. No. 09/457,776, filed Dec. 9, 1999; to U.S. Pat. No. 6,312,266, issued to Fan et al. for CARRIER FOR LAND GRID ARRAY CONNECTORS, which is based on application Ser. No. 09/645,860, filed Aug. 24, 2000; and to copending U.S. patent application Ser. No. 09/866,434, filed May 29, 2001, which is a non-provisional application based on provisional application Serial No. 60/227,859, filed Aug. 24, 2000, all of which are hereby incorporated by reference.

FIELD OF THE INVENTION

The present invention relates to electrical connectors and, more particularly, to electrical connectors for interconnecting electrical circuit members such as printed circuit boards, circuit modules, or the like, which may be used in information handling system (computer) or telecommunications environments.

BACKGROUND OF THE INVENTION

The current trend in design for connectors utilized in high speed electronic systems is to provide high electrical performance, high density and highly reliable connections between various circuit devices, which form important parts of those systems. The system may be a computer, a telecommunications network device, a handheld "personal digital assistant", medical equipment, or any other electronic equipment.

One way high electrical performance is manifested is in improved signal integrity. This can be accomplished by providing the interconnections with shielding that helps them to more closely match a desired system impedance. High reliability for such connections is essential due to potential end product failure, should vital misconnections of these devices occur. Further, to assure effective repair, upgrade, and/or replacement of various components of the system (e.g., connectors, cards, chips, boards, modules, etc.), it is also highly desirable that, within the final product, such connections be separable and reconnectable in the field. Such a capability is also desirable during the manufacturing process for such products in order to facilitate testing, for example.

A land grid array (LGA) is an example of such a connection in which each of two primarily parallel circuit elements to be connected has a plurality of contact points, arranged in a linear or two-dimensional array. An array of interconnection elements, known as an interposer, is placed between the two arrays to be connected, and provides the electrical connection between the contact points or pads.

LGA interposers described in the prior art are implemented in many different ways. Many of these were described and compared in U.S. patent application Ser. No. 09/645,860, U.S. Pat. No. 6,312,266. Compared to the prior art, the inventive LGA carriers described in that referenced patent application significantly improve the reliability of LGA carriers. But to improve the electrical performance, further invention is necessary.

One way to improve electrical performance of LGA connectors is to provide electrical shielding for each individual contact member and to emulate a coaxial cable by terminating each shield separately. This is impractical to implement, especially when space is limited and low costs are important. An alternative to this is to provide shielding of contact members where the shielding is terminated to the surrounding structures en masse. This provides a wide variety of alternatives that vary in complexity. The technique can provide a proper amount of shielding to one or more reference voltage levels of the surrounding structures in a more cost effective fashion.

At first viewing some of the elements of U.S. Pat. No. 5,599,193, issued to Crotzer for RESILIENT ELECTRICAL INTERCONNECT, appear similar to those of various embodiments of the invention. However further study shows significant differences. The embodiment in FIGS. 1 and 2 of CROTZER describes an LGA connector with non-conductive elastomeric elements formed at the same time as is the elastomeric carrier for the elements, through a process such as molding. The elastomeric elements are selectively plated on their outer surface to create a plurality of conductive elements. Unfortunately, since the conductive elements rely on plating on the outside of the elastomer for conductivity, it would not be feasible to shield them electrically. Also, since the elastomeric elements are integrally formed with the carrier, it would be extremely difficult to repair a conductive element that has been damaged. Therefore, when damaged, the entire connector must be scrapped. Furthermore, since the carrier is composed of elastomer, its coefficient of thermal expansion (CTE) is substantially different from that of the surrounding structures.

The embodiment in FIGS. 4 and 5 of CROTZER illustrates an LGA connector with a rigid carrier that has openings with a shape complementary to the externally conductive elastomeric elements. Again, since the conductive elements rely on plating on the outside of the elastomer for conductivity, it would not be feasible to shield them electrically.

The individual cavities in the carriers for most prior art LGA connectors are cylindrical in shape and provide a minimal amount of retention of individual contact elements. Unfortunately, this makes the assembly and the proper engagement of the connector more difficult, since the individual contact elements may tend to fall out or shift vertically. Although a missing contact element will always result in an open circuit, an element shifted vertically may lead to permanent or intermittent problems maintaining uniform electrical and mechanical properties, thereby significantly reducing the reliability of the interconnection. The exception to this is the apparatus described in copending U.S. patent application Ser. No. 09/645,860.

A carrier that provides electrical shielding of the individual contact elements will result in LGA interposer connectors with improved electrical performance, constituting a significant advancement in the art.

It is, therefore, an object of the invention to enhance the electrical connector art.

It is another object of the invention to provide a carrier for land grid array connectors with improved electrical performance.

It is an additional object of the invention to provide a carrier for land grid array connectors with improved contact element retention.

It is an additional object of the invention to provide a carrier for land grid array connectors that results in a connector with improved manufacturability.

It is an additional object of the invention to provide a low profile carrier and land grid array connector combination.

It is an additional object of the invention to provide a carrier and land grid array connector combination that is reworkable if a contact member is damaged.

It is a still further object of the invention to provide a carrier for land grid array connectors that ensures uniform electrical and mechanical performance.

SUMMARY OF THE INVENTION

The present invention provides a carrier with electrical shielding of individual contact elements, resulting in LGA interposer connectors with improved electrical performance. The carrier includes a plurality of openings, each of which may contain an individual contact element. The openings may be plated with conductive material, and may also be commoned to one or more reference voltages (e.g., ground) present on at least one conductive layer of the carrier. The carrier may be as simple as a single unified structure with a conductive layer on one outer surface, or much more complex, comprising many layers of dielectric and conductive material. The carrier may also provide improved retention of the individual contact elements. Description of the process to assemble one embodiment of the carrier is also disclosed.

BRIEF DESCRIPTION OF THE DRAWINGS

A complete understanding of the present invention may be obtained by reference to the accompanying drawings, when taken in conjunction with the detailed description thereof and in which:

FIG. 2*e* is a cross section, enlarged side view demonstrating the shielding aspects of the connector shown in FIG. 2*a.

DETAILED DESCRIPTION OF THE PREFERRED EMBODIMENT

Generally speaking, the present invention is a carrier that provides electrical shielding resulting in LGA interposer connectors with improved electrical performance. Improved retention of conductors, manufacturability, reliability and more uniform mechanical and electrical performance are achieved with this invention.

Figure 1A:
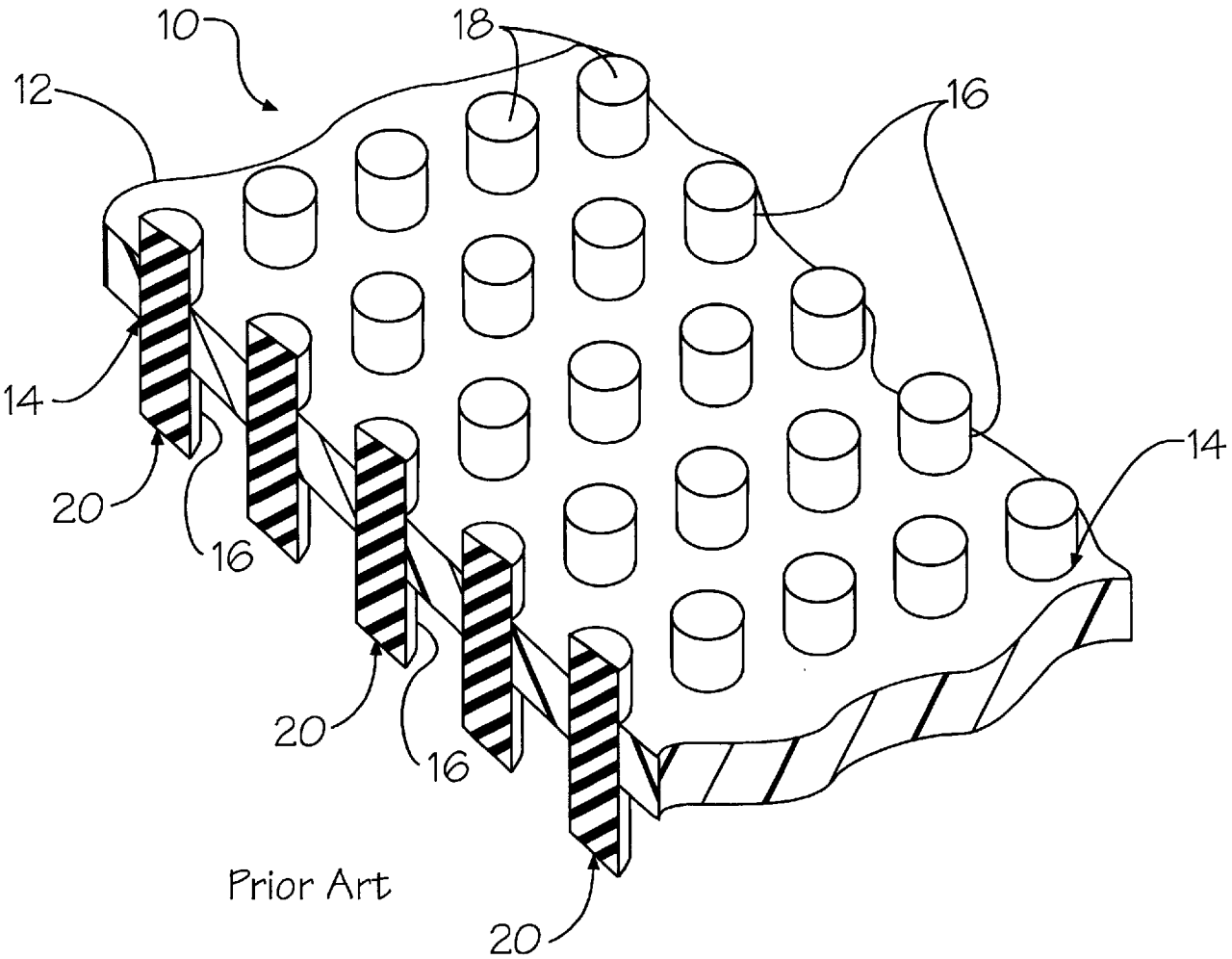
FIG. 1*a* is a partial perspective view of an electrical connector in accordance with the prior art.
Figure 1B:
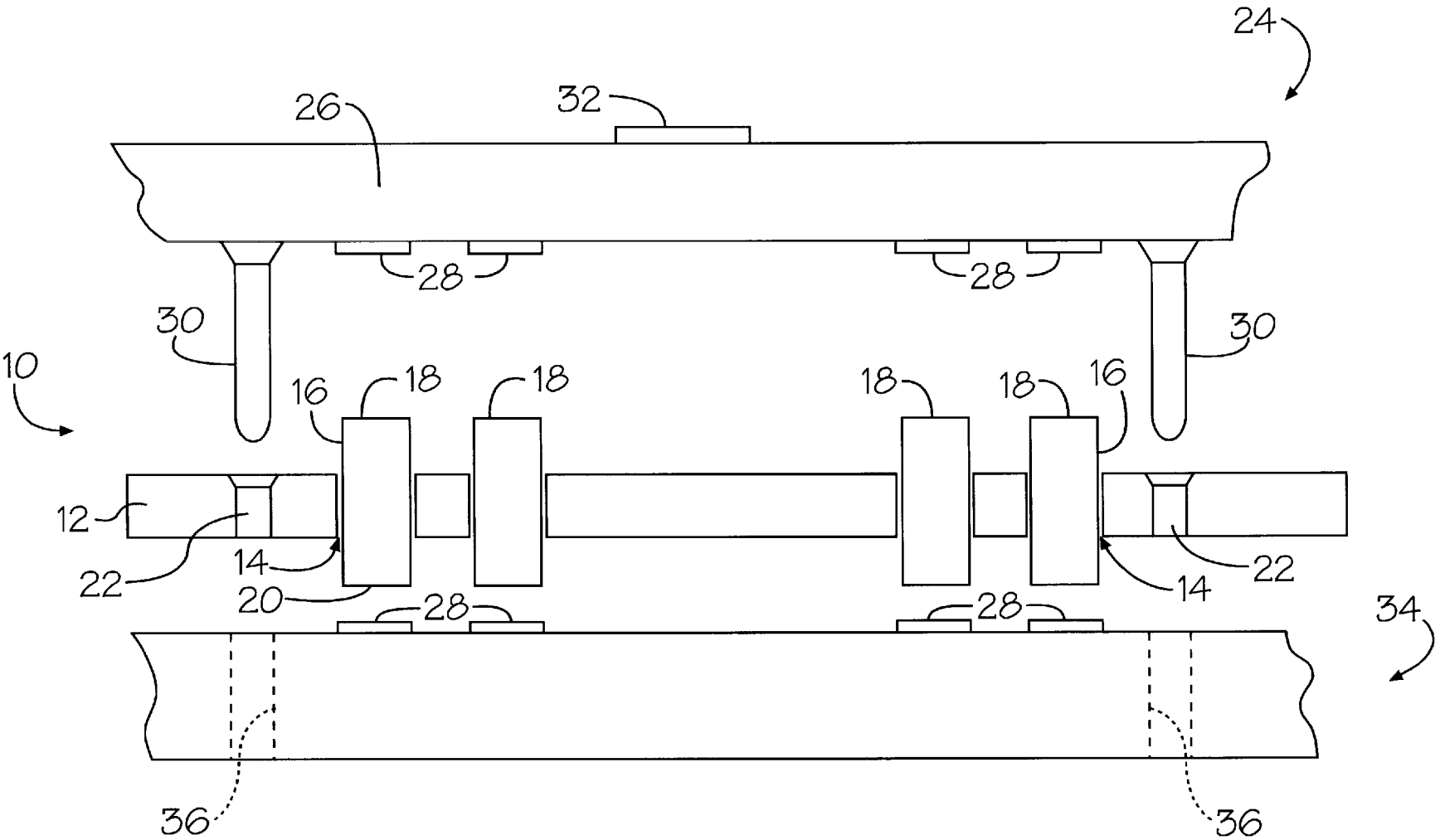
Prior Art Figure 1b
FIG. 1*b* is a cross section, enlarged side view of the prior art connector shown in FIG. 1*a,* the connector being located between and in alignment with a pair of circuit members for providing interconnection therebetween.

Referring first to FIGS. 1*a* and 1*b,* there are shown perspective and cross sectional views, respectively, of a connector 10 of the prior art for electrically interconnecting a pair of electrical circuit members 24 and 34. Examples of circuit members suitable for interconnection by connector 10 include printed circuit boards, circuit modules, etc. The term "printed circuit board" is meant to include but not be limited to a multilayered circuit structure including one or more conductive (i.e., signal, power and/or ground) layers therein. Such printed circuit boards, also known as printed wiring boards, are well known in the art and further description is not believed necessary. The term "circuit module" is meant to include a substrate or like member having various electrical components (e.g., semiconductor chips, conductive circuitry, conductive pins, etc.), which may form part thereof. Such modules are also well known in the art and further description is not believed necessary.

Connector 10 includes a common, electrically insulative carrier member 12 having a plurality of internal apertures or openings 14. The openings 14 are typically cylindrical in shape. Resilient contact members 16 are located so as to substantially occupy a respective opening 14 in carrier member 12.

Each opposing end 18 and 20 of each contact member 16 is designed for electrically contacting respective circuit members. As stated, these circuit members may be printed circuit boards 34 (FIG. 1*b*) having flat conductive pads (e.g., copper terminals) 28 located on an upper surface thereof. These circuit members may also comprise a circuit module 24 including a substrate 26 having a plurality of semiconductor elements 32 thereon. Corresponding thin, flat, copper conductive pads 28 can be located on a bottom, external surface on circuit module 24. Understandably, the conductive pads 28 are electrically coupled to corresponding circuitry, which forms part of the respective electrical circuit members. These pads 28 may provide signal, power or ground connections, depending on the operational requirements of the respective circuit member.

Connector 10 is designed for positioning between opposing circuit members 24 and 34, and for being aligning therewith. Such alignment is facilitated by positioning the carrier member 12, which may also include alignment openings 22.

Each resilient contact member 16 is compressed during engagement to form the appropriate interconnection between corresponding pairs of conductive pads 28.

As discussed hereinabove, openings 14 in carrier member 12, typically cylindrical in shape, provide neither electrical shielding nor much retention of individual resilient contact members 16. Unfortunately, this limits the use of the connector 10 for high speed operation and makes the assembly and the proper engagement of the connector more difficult, since the individual contact elements may tend to fall out or shift vertically. Although a missing contact element will always result in an open circuit, a shifted element may lead to intermittent problems maintaining uniform electrical and mechanical properties, thereby significantly reducing the reliability of the interconnections.

Referring now to FIGS. 2*a*–2*e,* there is shown a connector 40 of the present invention for electrically interconnecting a pair of electrical circuit members 24 and 34. Examples of suitable circuit members include printed circuit boards, circuit modules, etc.

Connector 40 includes a carrier member 42 having a plurality of internal openings 50, 51. In contrast to the prior art carrier member 12 (FIG. 1*b*), openings 50, 51 (FIG. 2*e*) in carrier member 42 are electrically conductive and are electrically connected to first shielding layer 57 and/or second shielding layer 58. In a preferred embodiment, carrier member 42 (FIG. 2*b*) consists of an upper section 44, upper spacers 52, a lower section 46, and lower spacers 54, with a retention layer 48 between the upper and lower sections 44, 46. In this embodiment, the openings 50, 51 are cylindrical in shape. It should be understood, however, that other geometric shapes can be used, as required, for the openings 50, 51 and corresponding contact members 16*a*–16*e*. The conductive portions of carrier 42 are intentionally not included in FIG. 2*b* for clarity purposes, but can be seen in FIG. 2*e*.

In this embodiment, upper section 44 and lower section 46 are made of epoxy-glass-based materials typically used in printed circuit board fabrication (e.g., FR4). These materials are preferred because their coefficient of thermal expansion (CTE) substantially matches the CTE of the surrounding structures, and because of their relatively low cost. Another possible material is polyimide. Each section 44 and 46 is 0.007 inch thick. Layer 48 consists of a 0.002-inch layer of Mylar® (a trademark of E. I. DuPont deNemours & Co., Wilmington, Del.) material. It should be understood by those skilled in the art that the components of the invention may consist of alternate materials, instead of the particular ones described in the disclosed embodiments, without departing from the spirit of the invention.

While a carrier 40 with single layers for the upper section 44, upper spacers 52, lower section 46, lower spacers 54, and retentive layer 48 between the upper and lower sections 44, 46 has been chosen for purposes of disclosure, it should be obvious that the principles taught by the instant invention can also be applied to structures having multiple layers of one or more of these elements. For example, for certain applications it may be desirable to split upper section 44 and lower section 46 in half and include an adhesive layer between each of the two halves.

Upper spacers 52 and lower spacers 54 are also preferably made of epoxy-glass-based materials typically used in printed circuit board fabrication. Each spacer 52 and 54 is 0.0055 inch thick. The overall thickness of carrier member 42 (including the upper and lower sections 44, 46, the upper and lower spacers, 52,54, and layer 48) is 0.027 inch. The function of spacers 52 and 54 is to limit the maximum amount that contact members 16*a*–16*c* may be compressed, which is from 0.040 to 0.027 inch in this case, and to provide electrical isolation between the shielding layers 57 and 58 on the top and bottom surface of the carrier 42, respectively, and the electrically conductive portions of contact members 16*a*–16*e*.

The inclusion of optional retentive layer 48 in electrically insulative carrier member 42 helps to alleviate deficiencies of the prior art carrier, those being to ensure that contact members 16*a*–16*e* (FIG. 2*e*) do not fall out during assembly or engagement and, more commonly, to ensure that all individual contact members maintain uniform electrical and mechanical properties, thereby significantly improving the reliability of the interconnections.

Retention layer 48 (FIG. 2*c*) has a plurality of smaller openings 45 formed by a plurality of retention segments 47 that are created by the removal of a portion of retention layer 48 and the segmentation of the remaining material within a larger opening 50 in carrier member 42. In one example, each larger opening 50 contains four retention segments 47 that form smaller circular opening 45. The specific dimensions of each of the elements of this invention can be varied to produce the desired amount of retention force on contact members 16*a*–16*e* (not shown in FIG. 2*c*).

The teachings of U.S. patent application Ser. No. 09/645,860 includes but is not limited to the multiple-layer carrier 42 with one or more retentive layers 48 and upper and lower spacers 52, 54 described hereinabove. Such structure is considered an important part of the carrier members disclosed herein, but are not included in the remaining figures, for improved clarity of other elements and features of the invention.

It should be understood that it is possible to construct a carrier 42 with electrical shielding without including the aforementioned contact member retentive means and still be within the scope of the invention; it is believed, however, that the inclusion of said features provides a superior solution.

Figure 2A:
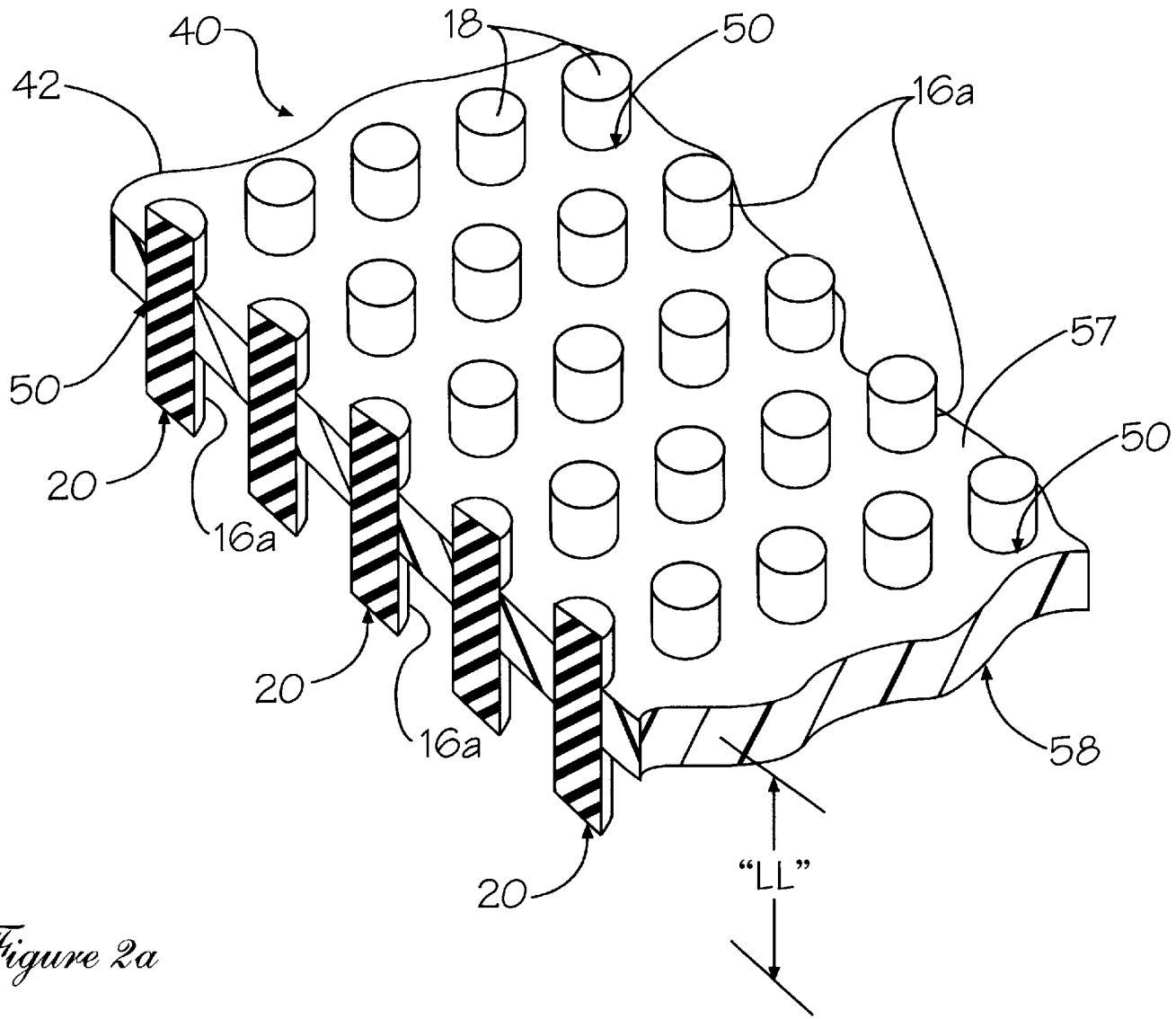
FIG. 2*a* is a partial perspective view of an electrical connector in accordance with one embodiment of the present invention.
Figure 2B:
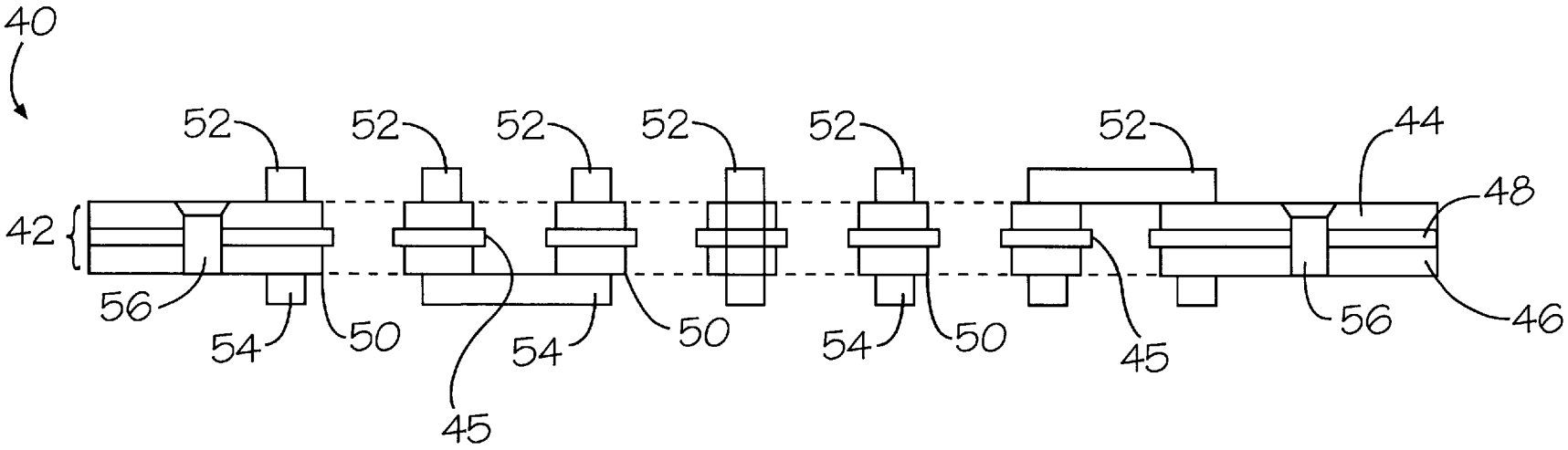
FIG. 2*b* is a cross section, enlarged side view of a preferred carrier member demonstrating the mechanical relationships of the connector shown in FIG. 2*a;*
Figure 2C:
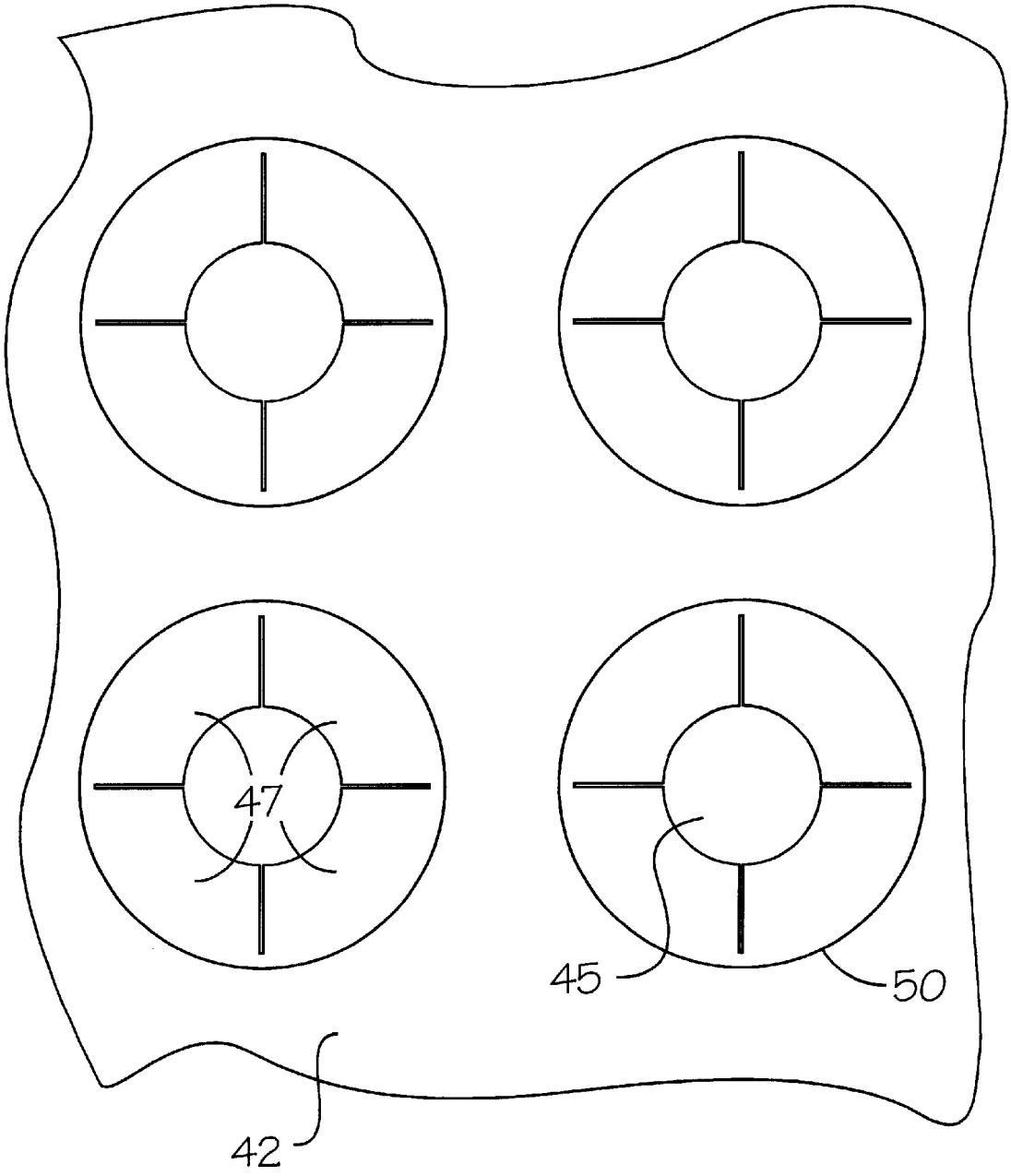
FIG. 2*c* is an enlarged top view of the carrier shown in FIG. 2*b;*
Figure 2D:
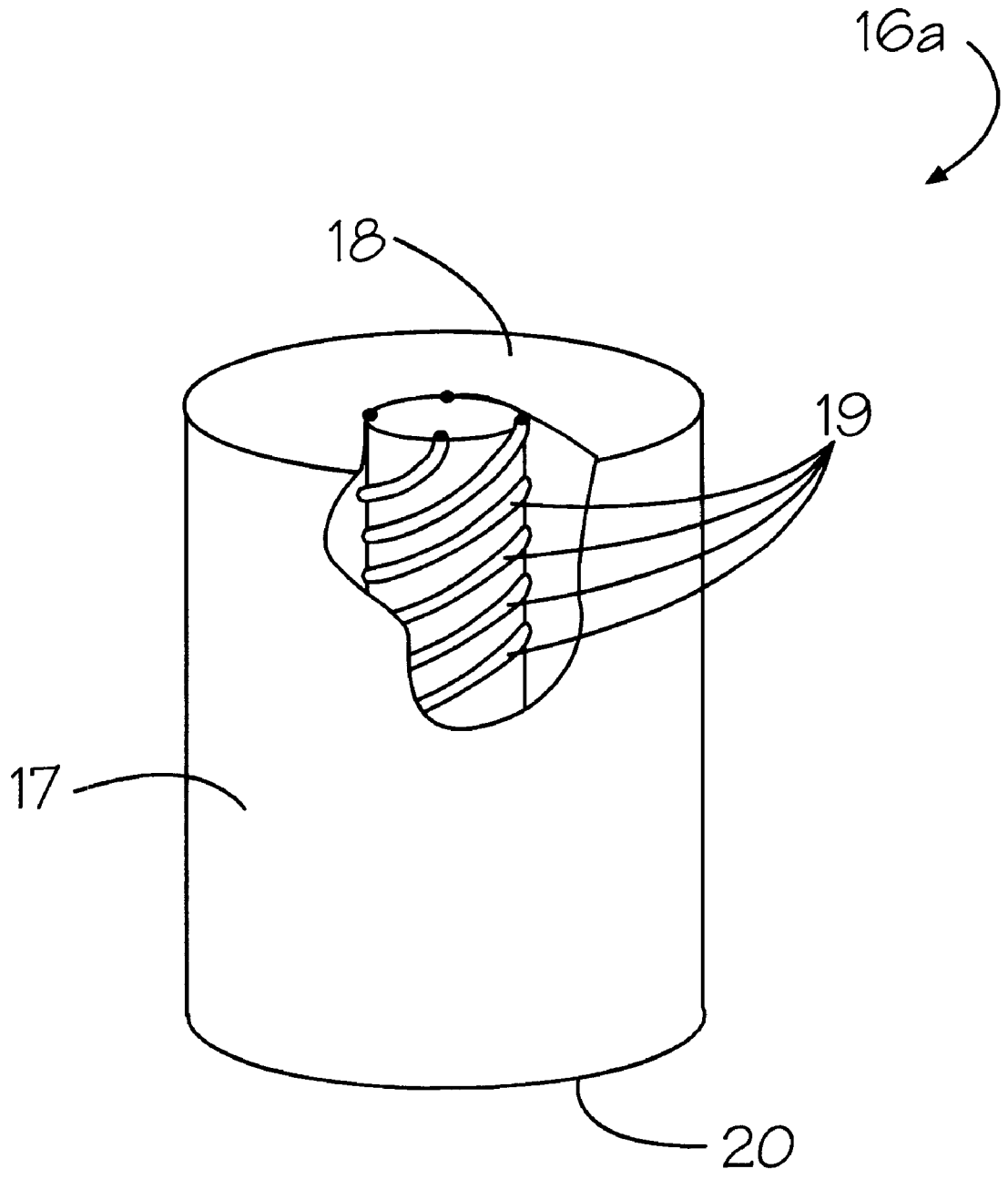
FIG. 2*d* is an enlarged perspective view of a contact member of the connector shown in FIG. 2*a;*

Referring now to FIG. 2*d*, there is shown a perspective view of an individual contact member 16*a*, comprising conductive opposing ends 18 and 20, conductors 19, and insulative side 17, which ensures electrical isolation from conductive openings 50. Contact members 16*a*, 16*b*, and 16*c* are all physically identical; only their intended function varies. Contact members 16*d* and 16*e* are similar, but slightly shorter.

Figure 2E:
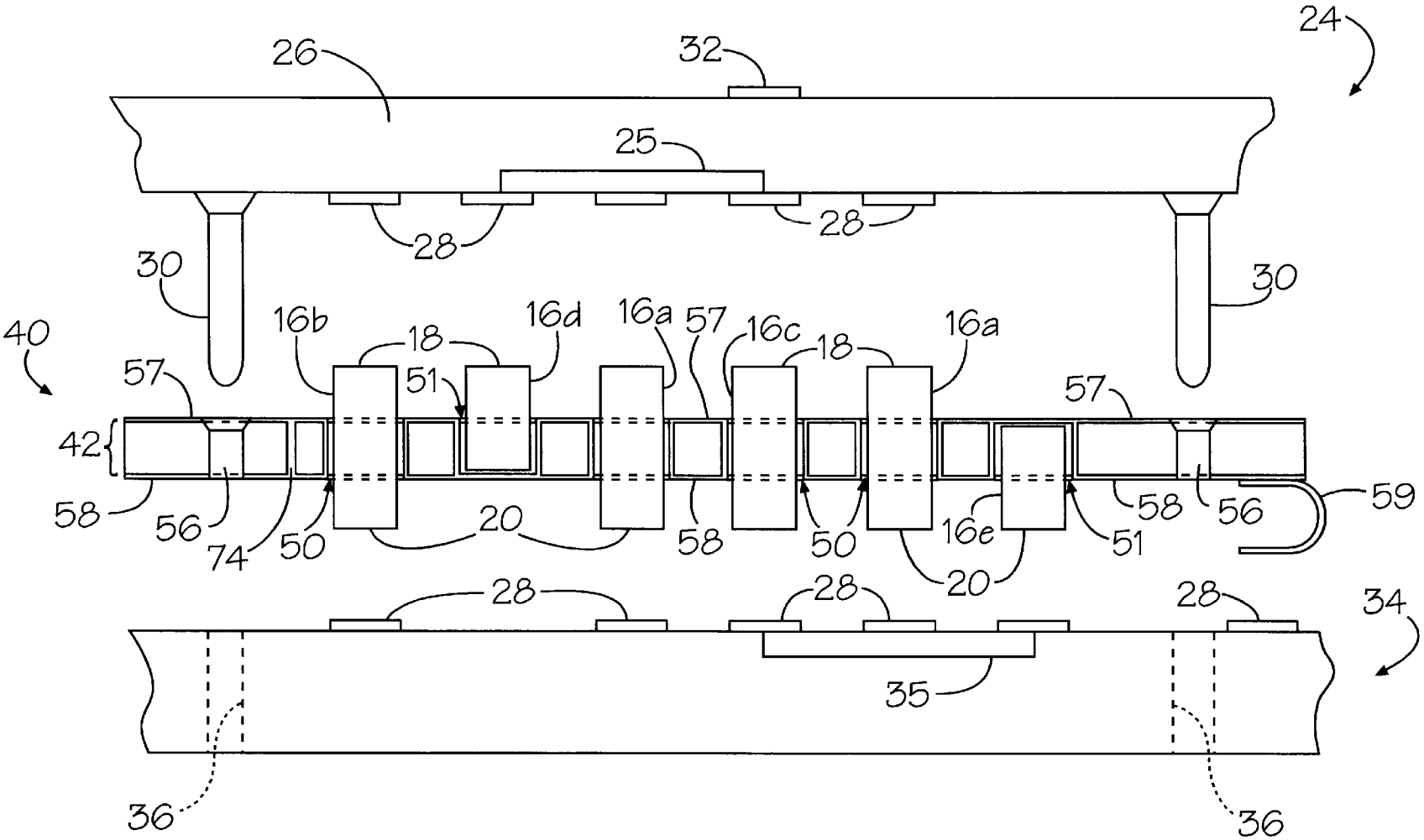

Referring now to FIG. 2*e*, there is shown a cross sectional view of connector 40 to illustrate the shielding aspects of carrier member 42. As aforementioned, in contrast to the prior art carrier member 12 (FIG. 1*b*), openings 50, 51 in carrier member 42 are electrically conductive and are electrically connected to first shielding layer 57 and/or second shielding layer 58. They are cylindrical in shape.

Each contact member 16*a*–16*c*, 16*d*–16*e* is located so as to substantially occupy an opening 50, 51, respectively, in carrier member 42. Contact members 16*a*–16*e* are preferably of a construction and composition as taught in copending U.S. patent application, Ser. No. 09/457,776, especially in FIGS. 2 and 3*a*–3*e* thereof. It is important that the sides 17 of the contact members 16*a*–16*e* that are not at the same electrical potential as the shielding layers 57, 58 and openings 50, be insulative to prevent shorting between the conductive portions of the contact members 16*a*–16*e* and the conductive openings 50. Upper and lower spacers 52, 54 (FIG. 2*b*) also help to ensure that the conductive portions of contact members 16*a*–16*e* will not short to first and second shielding layers 57, 58 located on the top and bottom surface, respectively, of carrier member 42. Upper and lower spacers 52, 54 also provide mechanical support behind respective shorter contact members 16*d*, 16*e* (FIG. 2*e*) to prevent damage such as cracking and/or peeling to the shielding layers 57, 58 of carrier member 42.

Each contact member 16*a*–16*c* may have a diameter of about 0.026 inch and a corresponding length of about 0.040 inch. Openings 50, 51 have a diameter of 0.028 inch, just a few thousandths of an inch larger than that of the contact members 16*a*–16*e*. The center-to-center distance is 0.050 inch, but could be reduced to about 0.035 inch or less, if required.

Openings 51 differ from openings 50 in that, instead of being completely open internally, they are enclosed at one end by one of the shielding layers 57, 58. They are intended to house one of the shorter contact members 16*d*–16*e* for use as described below.

For any given application, an individual contact member may be used to provide a signal, power, or ground interconnection. In the example shown in FIG. 2*e*, contact members 16*a* are used for signals and contact members 16*b* are used for power. Shorter contact member 16*d* is used to connect second shielding layer 58 to a pad 28 on circuit member 24 at ground potential; the other shorter contact member 16*e* is used to connect first shielding layer 57 to a pad 28 on circuit member 34 also at ground potential. Contact member 16*c* is then used to connect the grounds in circuit members 24 and 34 through connecting traces 25 and 35, respectively.

It should be noted that contact members 16*d,* 16*e,* intended to contact one of the shielding layers 57, 58, are a different length than are other contact members. This is to ensure that opposing ends 18 and 20 of all contact members are at a uniform height to properly mate with conductive pads 28 of circuit members 24 and 34.

Although all contact members described hereinabove have been used to provide electrical interconnection, it is within the scope of the invention for certain contact members to be used for other purposes, such as for thermal reasons, including heat conduction, and mechanical reasons, including but not limited to balancing forces, minimizing deflection, and providing support. These contact members may differ in construction and, for example, need not include any conductive material, as they are not intended to provide electrical interconnection.

Even though the shielding layers 57, 58 in the present example are connected to ground, in some applications it may be desirable to connect them to another reference voltage or to segment the shielding layers. Certain sections can be connected to ground and others connected to other reference voltages. The inclusion of vias 74 in carrier 42 facilitates wiring and may provide improved shielding performance.

Conductive openings 50 can also improve the electrical quality of power conductors by lowering the inductance of the power-carrying contact members 16*b*.

Carrier member 42 may also include additional commoning means 59 to further improve the shielding by providing an additional return path. In this example the additional path is implemented as a connection to a pad 28 on circuit member 34.

Although two shielding layers are shown for purposes of disclosure, a carrier with one or even three or more shielding layers can also be used, depending on specific system electrical requirements. Also, if only minimal shielding is required, it may be possible to use only the shielding layers and not provide conductive openings.

Certain applications may not require shielding of a particular contact member and electrical isolation may actually be preferred. In those cases, it may be desirable to make certain openings 50 non-conductive or at least to electrically isolate them from the shielding layers 57, 58.

Still referring to FIG. 2*e,* as with the prior art, each opposing end 18 and 20 of contact member 16*a*–16*e* is designed for electrically contacting respective circuit members. These circuit members may be printed circuit boards 34 having flat conductive pads (e.g., copper terminals) 28 located in an upper surface thereof. These circuit members may also comprise a circuit module 24 including a substrate 26 having a plurality of semiconductor elements 32 thereon and corresponding flat conductive pads (e.g., thin copper elements) 28 located on a bottom, external surface. The conductive pads 28 are electrically coupled to corresponding circuitry, which forms part of the respective electrical circuit members. These pads 28 may provide signal, power or ground connections, depending on the operational requirements of the respective circuit member. It is preferred that conductive pads 28 be plated with a layer of metal (e.g., gold) to ensure reliable interconnection to connector 40.

Connector 40 is positioned between opposing circuit members 24 and 34, and is aligned therewith. Such alignment is facilitated by positioning the carrier member 42, which also includes alignment openings 56.

Alignment of the circuit members 24 and 34 relative to interim connector 40 may be provided utilizing a pair of protruding pins 30 which extends from one of the circuit members (e.g., module 24). These pins are aligned with and positioned within corresponding openings 56 within carrier member 42 and openings 36 (shown in phantom) within the other circuit member 34. It should be understood that other means of alignment are readily possible, including pins extending from opposing surfaces of carrier member 42 for inversion within corresponding openings within the respective circuit members. To adjust for tolerancing, one of the openings 56 within connector 40 may be of an elongated configuration, forming a slot, for example.

Each contact member 16*a*–16*e* is compressed during engagement to form the appropriate interconnection between corresponding pairs of conductive pads 28.

Figure 3:
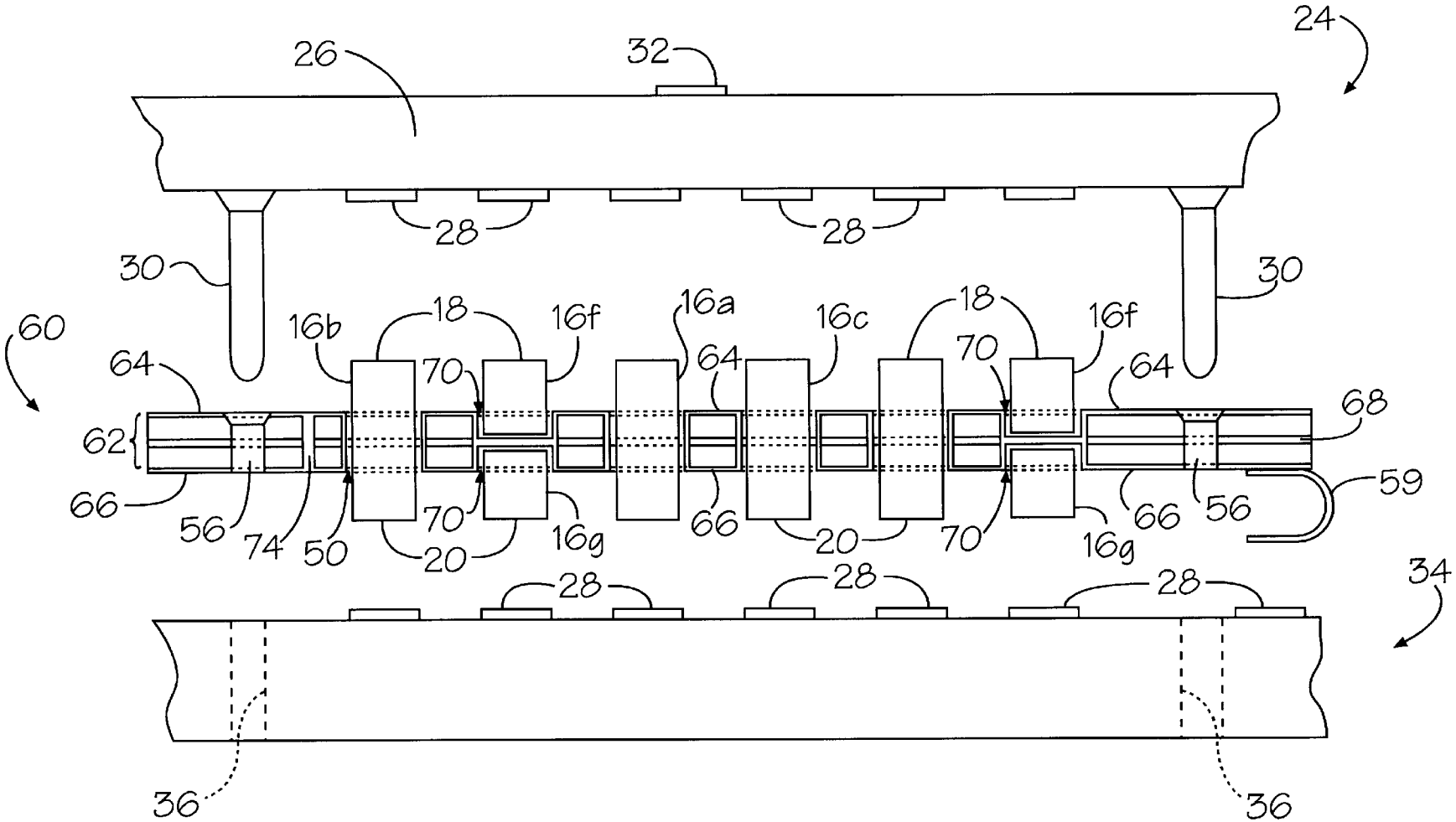
* and FIG. 3 is a side view of a carrier for an electrical connector in accordance with a second embodiment of the present invention.

Referring now to FIG. 3, there is shown a cross sectional view of a carrier member 62 to be used as part of a connector 60 in accordance with an alternate embodiment of the invention. The primary-purpose for using carrier member 62 over prior art carriers is the same as for carrier member 42 (FIGS. 2*b,* 2*e*): to provide a shielded carrier member for an LGA connector for electrically interconnecting a pair of electrical circuit members 24 and 34.

Connector 60 includes a carrier member 62 having a plurality of internal openings 50, 70. As in the first embodiment (FIGS. 2*a*–2*e*), openings 50, 70 are electrically conductive; they are electrically connected to an even greater number of shielding layers. For purposes of disclosure, three shielding layers 64, 66 and 68 are included. First shielding layer 64 and second shielding layer 66 are on external surfaces, as in the previous embodiment, but third shielding layer 68 is located internally. Again for simplicity, carrier member 62 is shown as a unified structure without retentive features, but could easily consist of multiple upper and lower sections and retentive layers as previously described. Also, features such as upper and-lower spacers are not included for clarity purposes. In this example the openings 50, 70 are again cylindrical.

Carrier 62 is preferably made of epoxy-glass-based materials typically used in printed circuit board fabrication. Dimensions for carrier 62 are similar to those of carrier 42 (FIG. 2*b*).

Contact member retentive means (FIG. 2*b*) is preferred but not required. Generally speaking, contact members for this embodiment are the same as for the embodiment depicted in FIGS. 2*d* and 2*e,* comprising conductive opposing ends 18 and 20, conductors 19, and an insulative side 17, which ensures electrical isolation from conductive openings 50. Again, contact members 16*a*–16*c* are all physically identical; only their intended function varies. Contact members 16*f* and 16*g* are similar, but are approximately one-half length, relative to contact members 16*a*–16*c*. They are used to make electrical connection to the shielding members (i.e., shielding layers 64, 66, 68 and conductive openings 50, 70) of carrier 62 through contact with third shielding layer 68 and pads 28 of the particular reference voltage (e.g., ground) of the surrounding circuit members 24 and 34.

Openings 70 differ from openings 50 in that instead of being completely open internally, openings 70 have at least one shielding layer 68 internal to them. This allows them to house two shorter contact members 16*f*–16*g* in one opening 70, one above and one below shielding layer 68.

Each contact member 16*a*–16*c* and 16*f*–16*g* is located so as to substantially occupy an opening 50 and 70, respectively, in carrier member 62. Contact members 16*a*–16*c* and 16*f*–16*g* are preferably of a construction and composition as taught in copending U.S. patent application, Ser. No. 09/457,776, especially in FIGS. 2 and 3*a*–3*e* thereof. It is important that the sides 17 of the contact members 16*a*–16*c* that are not at the same electrical potential as the shielding layers 64, 66, 68 and openings 50, be insulative to prevent shorting between the conductive portions of the contact members 16*a*–16*c* and the conductive openings 50. Upper and lower spacers 52, 54, as shown in FIG. 2*b*, also help to ensure that the conductive portions of contact members 16*a*–16*c* will not short to shielding layers 64, 66 located on the top and bottom respective surfaces of carrier member 62.

Each contact member 16*a*–16*c* may have a diameter of about 0.026 inch and a corresponding length of about 0.040 inch. Openings 50, 70 have a diameter of 0.028 inch, just a few thousandths of an inch larger than that of contact members 16*a*–16*c*, 16*f*–16*g*. The center-to-center distance is 0.050 inch, but could be reduced to about 0.035 inch or less, if required.

For any given application, an individual contact member may be used to provide a signal, power, or ground interconnection. In the example shown in FIG. 3, contact members 16*a* are used for signals, contact members 16*b* are used for power, and contact members 16*c* are used for ground. In this embodiment, for purposes of disclosure, shielding layers 64, 66, 68 and conductive openings 50, 70 are electrically referenced to ground. Shorter contact members 16*f* are used to connect the carrier shielding through third shielding layer 68 to pads 28 of circuit member 24 while the other shorter contact members 16*g* are used to connect the carrier shielding through third shielding layer 68 to pad 28 of circuit member 34. Contact member 16*c* and connecting traces 25 and 35 (FIG. 2*e*) are no longer required to interconnect the carrier'shielding to circuit members 24 and 34.

The inclusion of half-length contact members 16*f*, 16*g* provides benefits in at least three possible ways. First, since the contact members 16*f*, 16*g* are located in the same conductive opening 70, this removes the necessity for a separate, second opening for grounding, thereby allowing the second opening to be used for other purposes (e.g., another signal). The second opening can also be used to provide additional grounding of the carrier shielding by including an additional pair of contact members 16*f*, 16*g*. In either of the above cases, the loop inductance from openings 70 to the ground of circuit members 24 and 34 is significantly reduced, thereby improving electrical performance. Third, if the shielding without the second opening is adequate, the second opening can be removed, thereby reducing the total number of contacts and possibly the amount of space needed.

It should be noted again that contact members 16*f*, 16*g* are a different length from that of other contact members to ensure that opposing ends 18 and 20 of all contact members are a uniform height so as to mate properly with conductive pads 28 of circuit members 24 and 34.

Even though the three shielding layers 64, 66, 68 are connected to ground, in some applications it may be desirable to connect them to another reference voltage or to segment the layers and connect certain sections to ground and others to other reference voltages. The inclusion of vias 74 in carrier 62 facilitates wiring and may provide improved shielding performance.

Conductive openings 50 can also improve the electrical quality of power conductors by lowering the inductance of the power-carrying contact members 16*b*.

Carrier member 62 may also include additional commoning means 59 to further improve the shielding by providing an additional return path. In this example an additional path is implemented as a connection to a pad 28 on circuit member 34. Another option is to use protruding pins 30 and openings 56, which are primarily intended to be used for alignment purposes, as an additional return path. Openings 56 could be made conductive just like openings 16*a*–16*f*, and pins 30 could be electrically connected to circuit member 24 and possibly made in the form of a compliant fit pin to provide a better connection to the openings 56.

Certain applications may not require shielding of a particular contact member and electrical isolation may actually be preferred. In those cases, it may be desirable to make certain openings 50 non-conductive or at least to isolate them electrically from the shielding layers 64, 66, 68.

As with the prior art, each opposing end 18 and 20 of contact member 16*a*–16*c*, 16*f*–16*g* is designed for electrically contacting respective circuit members. These circuit members may be printed circuit boards 34 having flat conductive pads (e.g., copper terminals) 28 located in an upper surface thereof. These circuit members may also comprise a circuit module 24 including a substrate 26 having a plurality of semiconductor elements 32 thereon and corresponding flat conductive pads (e.g., thin copper elements) 28 located on a bottom, external surface. The conductive pads 28 are electrically coupled to corresponding circuitry, which forms part of the respective electrical circuit members. These pads 28 may provide signal, power or ground connections, depending on the operational requirements of the respective circuit member. It is preferred that conductive pads 28 be plated with a layer of metal (e.g., gold) to ensure reliable interconnection to connector 60.

Connector 60 is positioned between opposing circuit members 24 and 34, and is aligned therewith. Such alignment is facilitated by placing the carrier member 62, which also includes alignment openings 56. Alignment of the circuit members 24 and 34 relative to interim connector 60 may be provided utilizing a pair of protruding pins 30 which extends from one of the circuit members (e.g., module 24). These pins are aligned with and positioned within corresponding openings 56 within carrier member 62 and openings 36 (shown hidden) within the other circuit member 34. It should be understood that other means of alignment are possible, including the provision of pins extending from opposing surfaces of carrier member 62 for inversion within corresponding openings within the respective circuit members. To adjust for tolerancing, one of the openings 56 within connector 60 may be of an elongated configuration, forming a slot, for example.

Each contact member 16*a*–16*c*, 16*f*–16*g* is compressed during engagement to form the appropriate interconnection between corresponding pairs of conductive pads 28.

It is well known to those skilled in the art that the electrical impedance of a conductor relative to a voltage reference depends on the geometry and spacing of the conductor and reference, as well as the dimensions and materials of the insulative material between them. Through the choices of specific materials and dimensions for the components of contact members 16*a*–16*g* (FIGS. 2*d*, 2*e*, 3) and the diameter of openings 50, 51, 70, the electrical impedance of contact members 16*a*–16*g* may be controlled and optimized for specific applications. For example, the impedance of signal-carrying contact members 16*a* may be matched to the impedance of other components such as circuit members 24 and 34. This is especially important for the overall system electrical performance as semiconductor speeds continue to increase, and as semiconductor voltages and "noise budgets" continue to decrease. In one high speed memory subsystem the electrical impedance is 28 ohms. It is also possible to optimize power- and ground-carrying circuit members 16*c*–16*g* by using different dimensions and/or materials to obtain a much lower impedance, and therefore a much lower inductance for them.

Carrier member 62 (FIG. 3) may be constructed in many different ways. A preferred method is to provide a first layer of FR4 that has a layer of copper on one side, which is to be used for shielding purposes. Remove the protective sheet from one side of an adhesive layer and laminate it to the non-copper side of the FR4. A temperature of 185 degrees F. and a pressure of 20 pounds per square inch (PSI) can be used. Drill or route the FR4/adhesive composite to form the necessary holes and openings, including alignment features and the outer edges of the carrier. Mask both sides of a copper sheet. Etch away the exposed copper to create an etched copper sheet that has copper in the necessary locations for shielding purposes. Remove the remaining protective sheet from the FR4/adhesive composite and laminate it to the etched copper sheet. Prepare a second FR4/adhesive layer composite with copper on the opposite side of the first composite, again for shielding purposes. Drill the second FR4/adhesive composite to form the necessary holes, openings, and the outer edges of the carrier. Remove the remaining protective sheet from the second FR4/adhesive composite and laminate it to the first FR4/adhesive/etched copper layer composite so that the etched copper layer is located between and separated from the two copper layers by the FR4 layers. Create the necessary plated-through-holes and vias in the overall structure. Additional FR4 layers can be used to form material to be used for the upper and lower spacers.

The upper and lower spacer layers can be prepared from the additional FR4 layers by use of a computer numerically controlled (CNC) drilling machine. The upper and lower spacer layers can then be aligned and attached to the top and bottom surfaces of the overall structure. A simpler carrier without an interior shielding layer can be constructed merely by omitting the second FR4/adhesive composite. To add retentive features to the carrier, the first and second FR4 layers may be replaced by laminated composite structures consisting of, for example, two thinner layers of FR4 with an intermediate layer of Mylar material.

Since other modifications and changes varied to fit particular operating requirements and environments, including dimensions and material selections, will be apparent to those skilled in the art, this invention is not considered limited to the examples chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A carrier for land grid array connectors, comprising:

a) a substrate comprising at least one layer of dielectric material having a top surface and a bottom surface, and at least one shielding layer disposed on one of said surfaces; and b) a plurality of openings in said substrate, at least one of said plurality of openings being electrically conductive and positioned to accept a contact member for use in a land grid array connector.

2. The carrier for land grid array connectors as recited in claim 1, wherein said substrate comprises at least one insulative material.

3. The carrier for land grid array connectors as recited in claim 2, wherein said at least one insulative material is epoxy-glass-based.

4. The carrier for land grid array connectors as recited in claim 3, wherein said at least one insulative material comprises FR4.

5. The carrier for land grid array connectors as recited in claim 2, wherein said at least one insulative material comprises polyimide.

6. The carrier for land grid array connectors as recited in claim 1, wherein said substrate further comprises a plurality of spacers.

7. The carrier for land grid array connectors as recited in claim 6, wherein said plurality of spacers is located above said upper surface.

8. The carrier for land grid array connectors as recited in claim 6, wherein said plurality of spacers is located below said bottom surface.

9. The carrier for land grid array connectors as recited in claim 6, wherein said spacers comprise at least one insulative material.

10. The carrier for land grid array connectors as recited in claim 9, wherein said at least one insulative material is epoxy-glass-based.

11. The carrier for land grid array connectors as recited in claim 10, wherein said at least one insulative material comprises FR4.

12. The carrier for land grid array connectors as recited in claim 1, wherein: each of said plurality of openings is substantially cylindrical.

13. The carrier for land grid array connectors as recited in claim 1, wherein said substrate further comprises alignment means.

14. The carrier for land grid array connectors as recited in claim 1, wherein said substrate further comprises retentive means in at least one of said plurality of openings to compress and retain at least a portion of a contact member.

15. The carrier for land grid array connectors as recited in claim 14, wherein said contact member has a controlled electrical impedance.

16. The carrier for land grid array connectors as recited in claim 1, wherein said carrier further comprises a plurality of vias.

17. The carrier for land grid array connectors as recited in claim 1, wherein said carrier further comprises commoning means electrically connected to said at least one shielding layer.

* * * * *